US005355912A

United States Patent [19]

Corain et al.

[11] Patent Number: 5,355,912

[45] Date of Patent: Oct. 18, 1994

[54] ELASTIC DEFORMATION DEVICE FOR AUTOMATICALLY CONTROLLING THE WARP TENSION IN A LOOM

[75] Inventors: Luciano Corain, Vicenza; Roberto Spanevello, Schio; Marco Novella, Valdagno, all of Italy

[73] Assignee: Nuovopignone-Industrie Meccaniche e Fonderia SpA, Florence, Italy

[21] Appl. No.: 127,678

[22] Filed: Sep. 27, 1993

[30] Foreign Application Priority Data

Oct. 1, 1992 [IT] Italy ..... MI 92/A/002279

[51] Int. Cl.[5] ..... D03D 49/10

[52] U.S. Cl. ..... 139/110

[58] Field of Search ..... 139/110, 114, 103, 109; 73/760, 781

[56] References Cited

U.S. PATENT DOCUMENTS

| | | | |
|---|---|---|---|
| 3,526,252 | 9/1970 | Hindle | 139/110 |
| 3,878,872 | 4/1975 | Hintsch | 139/110 X |
| 4,064,744 | 12/1977 | Kistler | 73/781 X |
| 4,690,176 | 9/1987 | Thalmann et al. | 139/114 X |
| 4,942,908 | 7/1990 | Imamura | 139/110 X |

*Primary Examiner*—Andrew M. Falik

*Attorney, Agent, or Firm*—Morgan & Finnegan

[57] ABSTRACT

A device for automatically controlling the warp yarn tension in a loom in which the fixed deviation bar for the fabric under formation is supported only at its ends. A deformation sensor, moreover, is directly supported on the deviation bar. The deformation sensor is electrically connected to a comparator to which an adjustable set-value unit is also connected, the output of the comparator being used to drive the geared motor of the warp yarn feed beam to control the warp yarn tension.

1 Claim, 1 Drawing Sheet

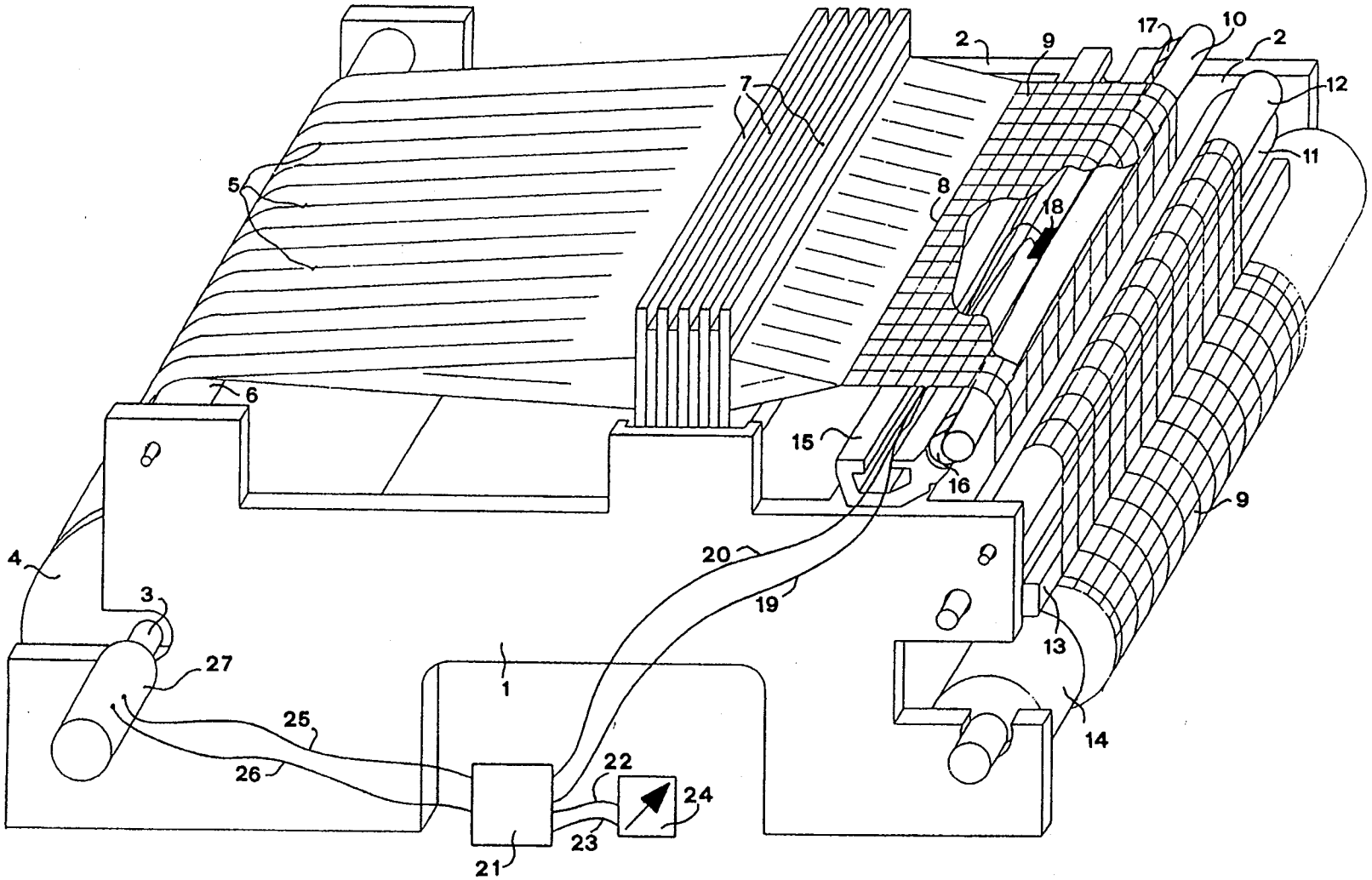
1
2
2
3
4
5
6
7
8
9
9
10
11
12
13
14
15
16
17
18
19
20
21
22
23
24
25
26
27

ELASTIC DEFORMATION DEVICE FOR AUTOMATICALLY CONTROLLING THE WARP TENSION IN A LOOM

BACKGROUND OF THE INVENTION

1. Field of the Invention

This invention relates to a control device which, by measuring the elastic deformation induced in the deviation bar by the tension of the fabric under formation and hence extending its action over the entire weaving width, allows effective, accurate and simple automatic control of the warp yarn tension in a loom.

2. Description of the Prior Art

As is well known, in a loom the warp yarn tension must be constantly controlled otherwise it would vary as the delivery of said yarn by the beam proceeds, because the radius of the yarn wound on the beam decreases whereas the angular velocity of this latter remains constant, the tangential delivery speed of the warp yarn hence decreasing, with consequent increase in the yarn tension.

In the current state of the art various types of devices are already known for controlling the warp yarn tension. With the most commonly used type the loom yarn holder is mounted on a rocker arm and opposed by a spring which is loaded to an extent representing the desired tension for the warp yarn, the inclination of said rocker arm to its normal working position being determined by a proximity sensor which drives the geared operating motor for said beam. In this manner indirect control of the warp tension is achieved by inclining said rocker arm to its normal working position.

Such a known device is of simple low-cost construction but has the drawback of not being able to maintain the warp yarn tension constant when the rocker am remains in its normal working position, following the different angular attitude which the warp yarn assumes as the yarn is finishing on the beam.

To eliminate this drawback a fixed deviator roller is generally positioned in the path of the warp yarn between the beam and the yarn holding roller, resulting in a constant warp yarn direction towards the yarn holding roller as the inclination of said warp varies due to the continuous depletion of the yarn package on the beam.

In addition to an obviously greater cost, this method has however the drawback common to all elastic mechanical systems, ie of having an inherent resonance frequency and an inherent inertia and of being subject to friction, which by introducing phasing errors and hence delays in intervention, results in deleterious abnormal excess tension in the warp yarn both during loom starting and during normal working.

A control device is also known which does not suffer from these drawbacks. In this device the warp yarn tension is controlled by a tension sensor supported by a fixed deviation bar for the fabric under formation and directly measuring the tension in the fabric, this evidently being the same as the warp yarn tension given that this yarn is connected to the fabric.

This device suffers however from the drawback that current tension sensors are of such dimensions as to be able to measure only the average tension in a small band of the fabric, so that the measurement cannot be sufficiently representative of the actual tension to which the entire width of the fabric and hence the entire warp yarn is effectively exposed.

SUMMARY OF THE INVENTION

The object of the present invention is to obviate said drawback by providing a control device which extends its action across the entire weaving width and hence ensures precise and effective control of the tension in the loom warp yarn.

This is substantially attained in that the effective warp yarn tension is determined indirectly by the elastic deformation which said tension generates over the entire forming fabric deviation bar, which for this purpose is supported only at its ends to allow it to undergo flexure.

In other words, a deformation sensor such as an extensometer is used which when applied dire.ctly to the deviation bar measures its deformation, which is indicative of the warp yarn tension, this measured value then being compared with a set value corresponding to the desired warp yarn tension value, the difference between the two said values being used to drive the geared motor which operates the beam.

This ensures that the warp yarn tension always equals the predetermined set value, as the value measured by the sensor is that which effectively acts on all the warp yarns.

Hence, the device for automatically controlling the warp yarn tension in a loom comprising a warp yarn feed beam, a geared electric motor for operating said beam and a fixed deviation bar for the fabric under formation, is characterised according to the present invention in that said fixed deviation bar is supported only at its ends to allow it to undergo flexure and has directly fixed to it a deformation sensor which is electrically connected to one input of a comparator having its other input connected to an adjustable set-value unit and its output connected to said beam geared motor.

The invention is described in detail hereinafter with reference to the accompanying drawing which illustrates a preferred embodiment thereof given by way of non-limiting example only, in that technical or constructtonal modifications can be made thereto but without leaving the scope of the present invention.

BRIEF DESCRIPTION OF THE DRAWING

In the sole figure of the drawing, the figure represents a partly sectional partial perspective view of a loom using the warp yarn tension control device in accordance with the invention.

DESCRIPTION OF THE PREFERRED EMBODIMENT(S)

In the figure, the reference numerals 1 and 2 indicate respectively the two fixed loom shoulders supporting the shaft 3 of the beam 4 which feeds the warp yarns 5. Said warp yarns 5 pass about the yarn holder 6,pass through the heddle frames 7 and form the edge 8 of the forming fabric 9 which is deviated by the fixed deviation bar 10 to pass about the take-up roller 11, about the reversal roller 12 and about the diverting bar 13 to wind onto the beam 14 rotatably supported by said shoulders 1 and 2. Said fixed deviation bar 10 is fixed at its ends to a support girder 15, supported by said shoulders 1 and 2, via two spacers 16 and 17 which enable it to flex towards the girder 15. On said bar 10 there is mounted a deformation sensor 18 which is electrically connected by the leads 19 and 20 to one input of a comparator 21, the other input of which is connected to an adjustable set-value unit 24 by the electrical leads 22 and 23. The output of said comparator is connected by the electrical leads 25 and 26 to the geared electric motor 27 which operates said beam 4.

The method of operation of such a control device is as follows. If the tension in the warp yarns 5 and hence in the forming fabric 9 increases for any reason, the sensor 18 provides a signal greater than the predetermined set value, with the result that the comparator 21 provides a positive difference signal which correspondingly causes the unwinding speed of the beam 4 to increase, this resulting in a reduction in the warp yarn tension until it reaches the required predetermined set value. In contrast, a tension reduction causes the comparator 21 to provide a negative difference signal which causes the unwinding speed of the beam 4 to decrease, resulting in an increase in the warp yarn tension to the required value.

We claim:

1. A device for automatically controlling the warp yarn tension in a loom comprising a warp yarn feed beam, a geared electric motor for operating said beam and a fixed deviation bar for the fabric under formation, characterized in that said fixed deviation bar is supported only at the ends of said deviation bar to allow said bar to undergo flexure in response to the warp yarn tension, a deformation sensor directly fixed to said bar, said deformation sensor being electrically connected to one of two imputs of a comparator, the other input of said comparator being connected to an adjustable set-value unit, and the output of said comparator being connected to said geared motor, whereby said comparator output drives the geared motor to operate said beam to control the warp yarn tension in response to said two comparator inputs.

* * * * *

UNITED STATES PATENT AND TRADEMARK OFFICE

CERTIFICATE OF CORRECTION

PATENT NO. : 5,355,912

DATED : October 18, 1994

INVENTOR(S) : Luciano Corain et al.

It is certified that error appears in the above-indentified patent and that said Letters Patent is hereby corrected as shown below:

Column 4, line 11, delete "imputs" and substitute – inputs –

Signed and Sealed this

Twenty-sixth Day of September, 1995

*Attest:*

Bruce Lehman

BRUCE LEHMAN

*Attesting Officer*

*Commissioner of Patents and Trademarks*